United States Patent [19]

Goss et al.

[11] Patent Number: 4,794,229

[45] Date of Patent: Dec. 27, 1988

[54] FLEXIBLE, ELONGATED THERMISTOR HEATING CABLE

[75] Inventors: David C. Goss, San Marcos; Chandrakant M. Yagnik, Austin, both of Tex.

[73] Assignee: Thermon Manufacturing Company, San Marcos, Tex.

[21] Appl. No.: 42,177

[22] Filed: Apr. 24, 1987

[51] Int. Cl.[4] ..... H05B 3/10

[52] U.S. Cl. ..... 219/548; 219/528; 219/544; 29/611; 338/322

[58] Field of Search ..... 219/548, 528, 549, 550, 219/544, 546, 547

[56] References Cited

U.S. PATENT DOCUMENTS

| | | | |
|---|---|---|---|
| 3,243,753 | 3/1966 | Kohler | 338/31 |
| 3,351,882 | 11/1967 | Kohler et al. | 338/322 |
| 3,413,442 | 11/1968 | Buiting et al. | 219/390 |
| 4,017,715 | 4/1977 | Whitney et al. | 219/553 |
| 4,037,082 | 7/1977 | Tamada et al. | 219/541 |
| 4,045,763 | 8/1977 | Miyamoto et al. | 338/23 |
| 4,072,848 | 2/1978 | Johnson et al. | 219/528 |
| 4,091,267 | 5/1978 | Grant | 219/544 |
| 4,104,509 | 8/1978 | Van Bokestal et al. | 219/544 |
| 4,117,312 | 9/1978 | Johnson et al. | 219/548 |
| 4,250,400 | 2/1981 | Lee | 219/549 |
| 4,304,044 | 12/1981 | Lee | 29/611 |
| 4,327,282 | 4/1982 | Nauerth | 219/541 |
| 4,330,703 | 5/1982 | Horsma et al. | 219/548 X |
| 4,369,423 | 1/1983 | Holtzberg | 338/66 |
| 4,485,297 | 11/1984 | Grise et al. | 219/528 |

OTHER PUBLICATIONS

Owens Corning Fiberglass, Fiberglass Conductive Roving, Dec. 7, 1983.
Hercules, Inc., Magnamite Graphite Fibers.
Fiber Materials, Inc., Electrically Semi-Conductive Yarns-Aug. 1981.
Celion Carbon Fibers Materials Safety Data Sheet, Oct. 1985.
Stackpole, Properties of Graphite Grade 2916.
Afikim Carbon Fibers, General Information.
Union Carbide, Thornel Product Information.

*Primary Examiner*—E. A. Goldberg
*Assistant Examiner*—M. M. Lateef
*Attorney, Agent, or Firm*—Pravel, Gambrell, Hewitt, Kimball & Krieger

[57] ABSTRACT

A flexible heating cable using positive temperature coefficient thermistors as a primary heat source with the thermistors being electrically and mechanically connected to substantially flat, preferably braided, electrical conductors with dielectric material preferably separating the conductors. A covering of dielectric material preferably is used to electrically separate the cable from the environment. The cable construction improves the heat transfer from the thermistors to the environment and improves the temperature distribution of the cable.

13 Claims, 3 Drawing Sheets

FLEXIBLE, ELONGATED THERMISTOR HEATING CABLE

BACKGROUND OF THE INVENTION

1. Field of the Invention

The present invention relates to electrical heating cables that use positive temperature coefficient thermistors as self-regulator heaters.

2. Description of the Prior Art

As exemplified in U.S. Pat. No. 4,072,848, electrical heating cables have been used commercially for some time to provide heat to pipes and tanks in cold environments.

Heating cables as disclosed in U.S. Pat. No. 4,072,848 based their temperature control on the use of variable resistance heating materials which provide a self-regulating feature. The heating materials are generally formed into chips made of barium titanate or solid solutions of barium and strontium titanate which are made semiconductive by the inclusion of various dopants. These chips are referred to as positive temperature coefficient thermistors and have a relatively low temperature coefficient of resistance at low temperatures. As the temperature of the thermistor rises, a sharp rise in the resistance occurs at a point termed the "Curie point". The transition from low resistivity to high resistivity occurs at a relatively sharp point as shown in U.S. Pat. No. 4,072,848. As these chips are well known to those skilled in the art, no further discussion of their construction is necessary.

As a voltage is applied to the thermistor, the thermistor generates heat due to resistance effects. This heat is then transferred to the environment and used to heat up the surrounding environment, such as the pipe to which the cable is attached. As the temperature of the thermistor and the surrounding environment increases, the thermistor temperature reaches the Curie point, the heat producing capability of the thermistor is reduced and the thermistor cools down. Thus the thermistor temperature settles on or near the Curie point, with the temperature of the surrounding environment being based on the thermal conductivities of the various materials in contact with the thermistor.

Prior art thermistor-based heating cables had the problem of relatively low overall efficiencies because of the limited heat transfer from the thermistors to the surrounding environment. This limited heat transfer occurred because the thermal conductivity from the thermistor to the environment was relatively low, causing the thermistor temperature to rise to the Curie point or switch temperature at a lower total power output than would occur if good heat dissipation existed.

Additionally, conventional designs have not had a uniform temperature distribution without the need for a large number of thermistors, in part because of the poor thermal transfer properties of the materials used in constructing the cables.

U.S. Pat. Nos. 4,117,312, 4,250,400 and 4,304,044 attempted to solve the temperature distribution problem by the use of resistance wire connected between a thermistor chip and the various conductors carrying the voltage from the power source. In this way, the resistance wire performed the bulk of the heating and the thermistors were used as switches to switch in and out resistance wire legs. Non-resistance wire thermistor-based heating cables tended to have hot spots near the thermistor because of poor heat distribution throughout the length of the cable, so that hot spots developed and non-uniform heating of the environment occurred. The use of the resistance wire provided a more even distribution of produced heat, but had the disadvantage of requiring additional wire and components to produce a heating cable.

U.S. Pat. No. 4,104,509 attempted to resolve the heat transfer problem by using heat conducting, electrically insulating compounds of silicone rubber, magnesium oxide and silicone oxide or other compounds in the heating element casing to provide better heat dissipation for the thermistors. The use of this design required the use of additional materials from the simple design as shown in U.S. Pat. No. 4,072,848. Additionally, the suggested materials were hygroscopic, requiring water tight sealing of the heating element casing to allow proper, continued operation.

British Patent No. 1,306,907 used a rigid casing with an electrically insulated liquid to improve the heat transfer from the thermistors to the environment. This design had the problems of requiring additional components and the casing was rigid for proper operation, therefore limiting the uses of the cable to non-flexible applications.

U.S. Pat. No. 4,072,848 indicated that the conductors assisted the thermistors in heat dissipation. The conductors disclosed in U.S. Pat. No. 4,072,848 had a small surface area and small contact area with the thermistor so that the heat dissipated and transferred along the conductors was relatively limited. The dielectric or insulation materials were the primary means of heat conduction and the poor heating pattern and low thermal conductivity developed because of the poor heat transfer properties of the dielectric materials.

Additionally, the previous designs using thermistors in flexible heating cables induced large thermal and mechanical stresses on the mating surfaces of the thermistors and the voltage source conductors. This limited the flexibility or sizing of the copponents in the heating cable.

SUMMARY OF THE INVENTION

The heating cable of the present invention has substantially flat, preferably braided, electrical conductors disposed in overlying parallel relationship and having a plurality of longitudinally spaced thermistors electrically connected thereto, wherein the electrical conductors serve as the primary heat transfer means by dissipating heat produced by the thermistors away from them. Such construction results in a significantly better heat transfer between the conductors and the thermistor as compared to the prior art, thus allowing more heat to be removed from the thermistor. Also such construction enables the thermistor to produce much higher power levels with the same voltage before the thermistor reaches the self-limiting temperature or Curie point.

Such improved heat transfer improves the temperature distribution along the length of the cable because the heat is transferred along the electrical conductors which are good thermal conductors and away from the thermistors, limiting the amount of local heat and improving the heat balance of the cable.

The use of the braided electrical conductors significantly decreases the thermal or mechanical stresses which occur at the connections between the conductors and thermistors because of the dispersed multidirectional forces which are exerted because of the smaller size and greater number of wire strands in the braid as compared to wires used in the prior art.

DESCRIPTION OF THE PREFERRED EMBODIMENT

Figure 1:
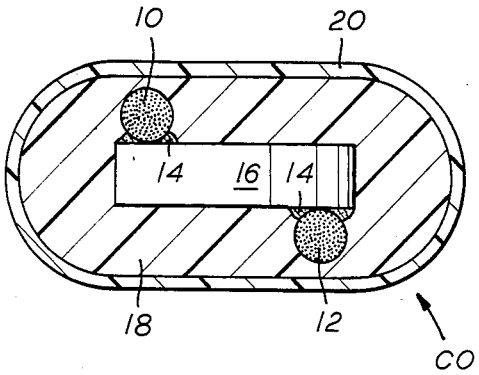
FIG. 1 (PRIOR ART)
FIG. 1 is a cross-sectional end view of a heating cable constructed according to the prior art.

Referring to the drawings, the letter C generally designates the heating cable of the present invention with the numerical suffix indicating the specific embodiment of the cable C.

FIG. 1 illustrates a heating cable C0 constructed according to the prior art. Wires 10 and 12 are attached to a thermistor 16 by various known soldering or brazing materials 14 to provide electrical contact between the wires 10, 12, and the thermistor 16 and form the electrical circuit of the heating cable C0. This assembly is surrounded by a dielectric insulating material 18 to provide the primary electrical insulation means for this heating cable C0. The primary insulation 18 is covered by an outer electrical insulation 20 to fully protect the heating cable C0 and the environment.

Figure 2:
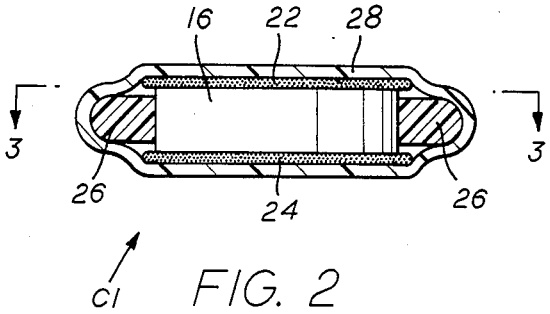
FIG. 2 is a cross-sectional end view of a heating cable according to the present invention.

FIG. 2 illustrates the preferred embodiment of a heating cable C1 constructed according to the present invention. A plurality of thermistors 16 are inserted into a separating dielectric insulator 26. The separating dielectric 26 contains a series of holes or cavities 27 (FIG. 3) in which the thermistors 16 are installed. The distance between the holes 27 is varied depending upon the specific size of thetthermistors 16 and the number of thermistors 16 required for a given desired thermal output of the heating cable C1. Preferably the holes 27 are slightly smaller than the size of the thermistors 16 so that the thermistors 16 are positively retained in the separating dielectric 26. The thermistors 16 are shown as being circular in cross-section, but any desired shape can be used, with the holes 27 have corresponding shapes. The dielectric material may be rubber, thermoplastic resins such as polyethylene, polytetrafluoroethylene, asbestos fiber, or any satisfactory material which is an electrical insulating material and is capable of withstanding the temperatures of the thermistors 16, while conducting sufficient heat as desired and being flexible to allow the heating cable C1 to be flexed as desired.

Flat, preferably braided, conductors 22, 24 are then installed parallel to each other in the longitudinal direction and on opposite sides of the separating dielectric 226 to provide the source of electrical energy converted by the thermistors 16 to produce heat. The flat conductors 22, 24 are attached to the thermistors 16 by soldering, brazing, welding or otherwise electrically and mechanically connecting the conductors 22, 24 to the plated surfaces of the thermistors 16. After the flat conductors 22,24 have been connected to the thermistors 16, an outer insulating layer 28 is provided to protect the eeating cable C1 from the environment. In this way, short circuit and potential shock conditions are prevented.

Surprisingly, such construction results in the parallel heating conductors 22, 24 becoming the primary heat transfer means, even though the wire gauge size is the same as used in previous heating assemblies. The use of the flat conductors 22,24 allows a lower thermal resistance of the conductor to thermistor junction because of the increased mechanical contact developed when connecting the thermistor to the conductor. This decreased thermal resistance in turn allows more heat to flow into the conductors 22, 24 which more readily conduct heat along their length than the dielectric layers or the round wire conductors 10, 12 of the prior art. Thus, by reason of this invention, more heat is removed from the thermistors 16 and the heat is more evenly distribueed along the length of the cable C1.

Figure 3:
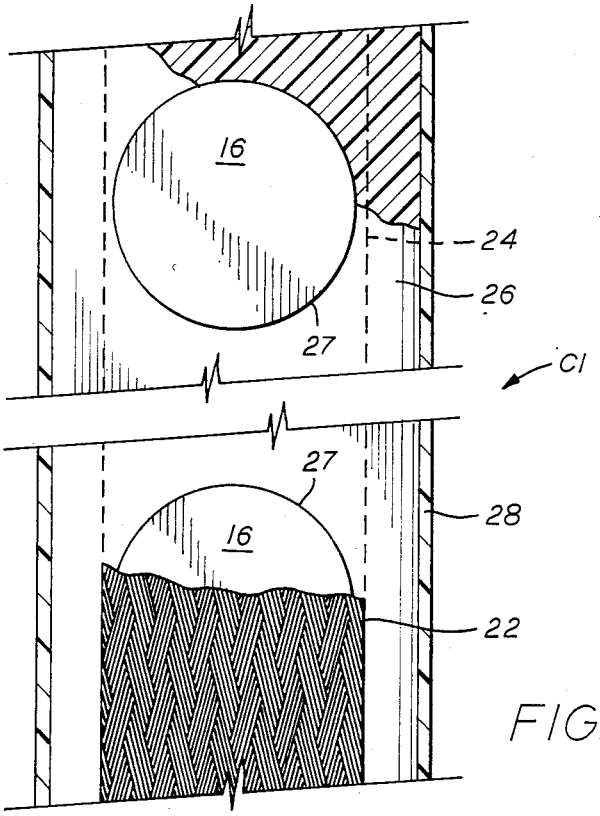
FIG. 3 is a cross-sectional top view of a heating cable according to the present invention.

The conductors 22, 24 are preferably formed of braided copper wire formed in flat strips of a width approximating the width of the heater cable, as best seen in FIGS. 2 and 3. An exemplary wire is a number 12 gauge wire which is ⅜" wide and 1/32" thick and is comprised of 48 carriers of 6 strands each, each strand being of 36 gauge wire, described as a 48-6-36 cable. This formation of the flat conductor is in contrast to conventional wires 10, 12, (FIG. 1) in which a 12 gauge copper wire is developed by utilizing 37 wires of number 28 gauge size. The individual copper strands may be coated with tin, silver, aluminum or nickel plated finish. In one embodiment, the conductors 22, 24 are formed of a plurality of parallel, stranded copper conductors. The gauge of each of the individual wires is smaller than the gauge of the conductors in the prior art design, but the plurality of wires develops the desired overall wire gauge. The individual wires are placed parallel and adjacent to each other along the length of the cable to substantially form a flat conductor having properties similar to the braided wire. Alternatively, the faat conductor can be woven from a plurality of carbon or graphite fibers, conductively coated fiberglass yarn or other similar materials of known construction as are commonly used in automotive ignition cables and as disclosed in U.S. Pat. No. 4,369,423. The fibers can be electroplated with nickel to further improve the conduciivity of the fibers. Sufficient numbers of the fibers are woven to provide a flat conductor which is capable of carrying the necessary electrical loads.

The flat conductor construction according to the present invention is preferably formed with a significantly larger number of smaller wires which are braided into a cross-hatched pattern. The increased number of contacts of smaller wrre and the cross-hatched pattern developed by the braided conductors decrease the thermal and mechanical stresses which occur at the connection between the conductor 22, 24 and the thermistor 16. The thermal stresses arise due to differing expansion rates and other reasons and the mechanical stresses occur due to the flexible nature of the cable C.. Because the braided wires are small and are arranged in several different directions in relation to the axis of the cable, the forces exerted are less, thereby increasing the reliability of the cable C1.

Figure 4:
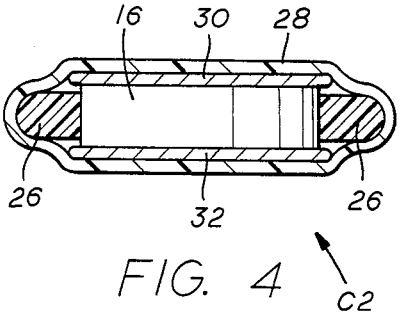
FIG. 4 is a cross-sectional end view of a heating cable according to the present invention.

The heating cable C2 (FIG. 4) is similar in construction and design to the cable C1, but utilizes solid, substantially flat copper strip conductors 30, 32 instead of the braided conductors 22, 24 of cable C1.

Figure 5:
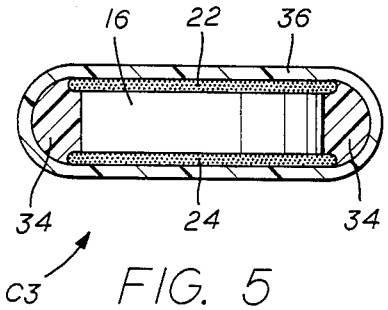
FIG. 5 is a cross-sectional end view of a heating cable according to the present invention.

The heating cable C3 shown in FIG. 5 is constructed in a different manner than that of cables C1 or C2. The heating cable C3 is prepared by placing the thermistors 16 in the desired locations between the upper and lower conductors 22, 24. There is no separating dielectric layer 26 installed at this time. The thermistors 16 are then connnected to the conductors 22, 24 by brazing, soldering, welding or otherwise electrically and mechanically connecting the surfaces. After the thermistors 16 and the conductors 22, 24 are connected to form the electrical assembly, a covering and separating dielectric material 34 is deposited between the conductors 22, 24 to keep them electrically and physically spaced from each other so that the dielectric material 34 separates the conductors 22, 24 to prevent short circuiting. This separated assembly then has an outer insulating layer 36 applied to prevent the electrical potential of the cable C3 from affecting the surrounding environment. This method of construction removes the need for a separately formed separating dielectric layer 26 and allows the dielectric layer which is used for conductor separation to be formed in place on the cable.

Figure 6:
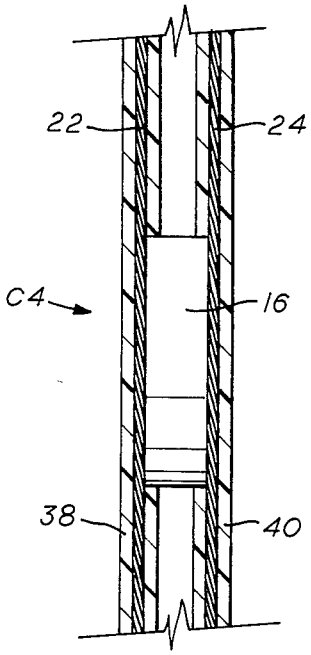
FIG. 6 is a cross-sectional side view of a heating cable according to the present invention.

Heating cable C4 (FIG. 6) is yet another alternative embodiment of a heating cable according to the present invention. In this embodiment, both of the electrical conductors 22, 24 are fully insulated by their own insulation layers 38, 40. These insulation layers 38, 40 contain openings where necessary so that the conductors 22, 24 are in electrical contact with the thermistors 16 to provide the electrical connections necessary for the thermistor 16 to perform its heating functions. This construction allows the cable C4 to be made without separate insulation for separating the conductors 22, 24.

EXAMPLE 1

Prior Art

Figure 7:
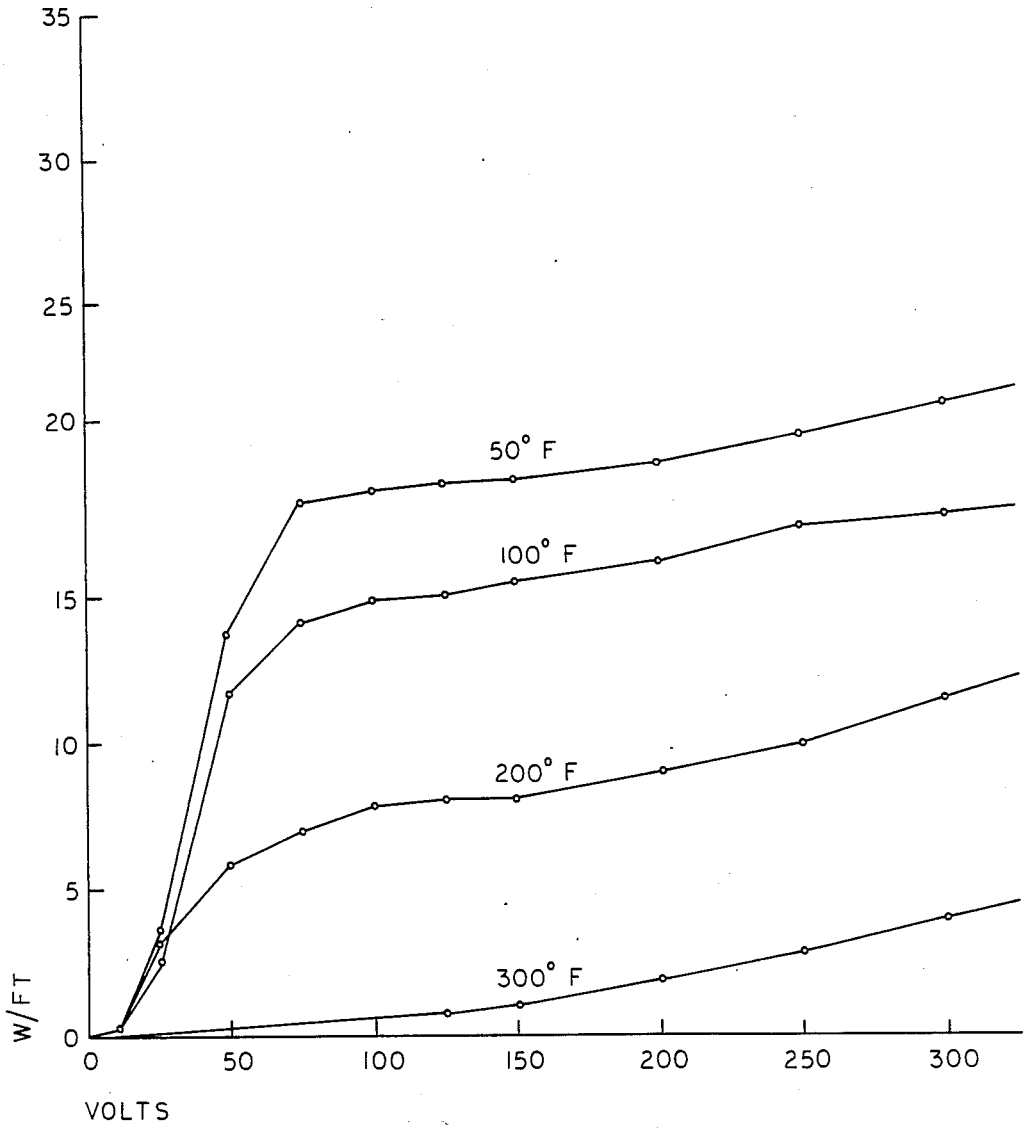
FIG. 7 (PRIOR ART)
FIG. 7 is a graph illustrating the unit power produced at given temperatures and given voltages for the heating cable of FIG. 1.

A thermistor heating cable C0 as shown in FIG. 1 was constructed. The thermistors 16 were rated for 300 volt operation and had a Curie temperature of 124°–128° C. The thermistors 16 were placed 4 inches apart along the length of the heating cable and connected to 12 gauge copper wires, 10, 12, which were of 37/28 stranded construction, with a silver bearing alloy. The assembly was electrically insulated with FEP Teflon®, an insulating material available from E.I. DuPont deNemours. The completed heating cable C0 measured a resistance of 263 ohms at a room temperature of 75° F. A one foot length of this cable CO was then installed in a environmental chamber capable of controlling the chamber temperature. The cable was energized at voltages ranging from 0 volts to 300 volts. Equilibrium temperatures of 50° F., 100° F., 200° F., and 300° F. were established in the environmental chamber and power consumption of the heating cable at the various voltages and temperatures was recorded. The results of this determination are shown in FIG. 7. The environmental chamber temperature was then set at 110° F. and the heating assembly was connected to a voltage supply of 120.2 volts. The resultant current reading was 0.121 amps producing 14.5 watts of power. While in this equilibrium condition of 110° F., thermocouple readings were taken on the outside surface of the outer insulation 20, with one reading being taken adjacent a thermistor 16 and a second measurement being taken at a point midway between two thermistors. The measured temperature at the thermistor location was 209° F. and the temperature at the mid point location was 165° F., for a temperature differential of 44° between the locations.

EXAMPLE 2

A heating cable C1 was constructed of copper wire braid according to FIGS. 2 and 3 with identical 300 volt and Curie temperature 124°–128° C. thermistors. The thermistors 16 were placed at 4 inch intervals along the dielectric strip 26. Flat, braided copper conductors 22, 24 having a 48-6-36 construction were then secured to the thermistors 16 with the same silver alloy as used in Example 4. This cable was then insulated with a similar FEP Teflon® insulation. The compleeed heating cable C1 measured a resistance of 270 ohms at a room temperature of 75° F. This heating cable C1 was then placed in the environmental chamber, and tested at equilibrium temperatures of 50° F., 100° F., 200° F., and 300° F. and energized at voltages ranging from 0 to 300 volts as in the previous example. The power consumption at the various voltages and temperatures was recorded and the results are shown in FIG. 8.

Figure 8:
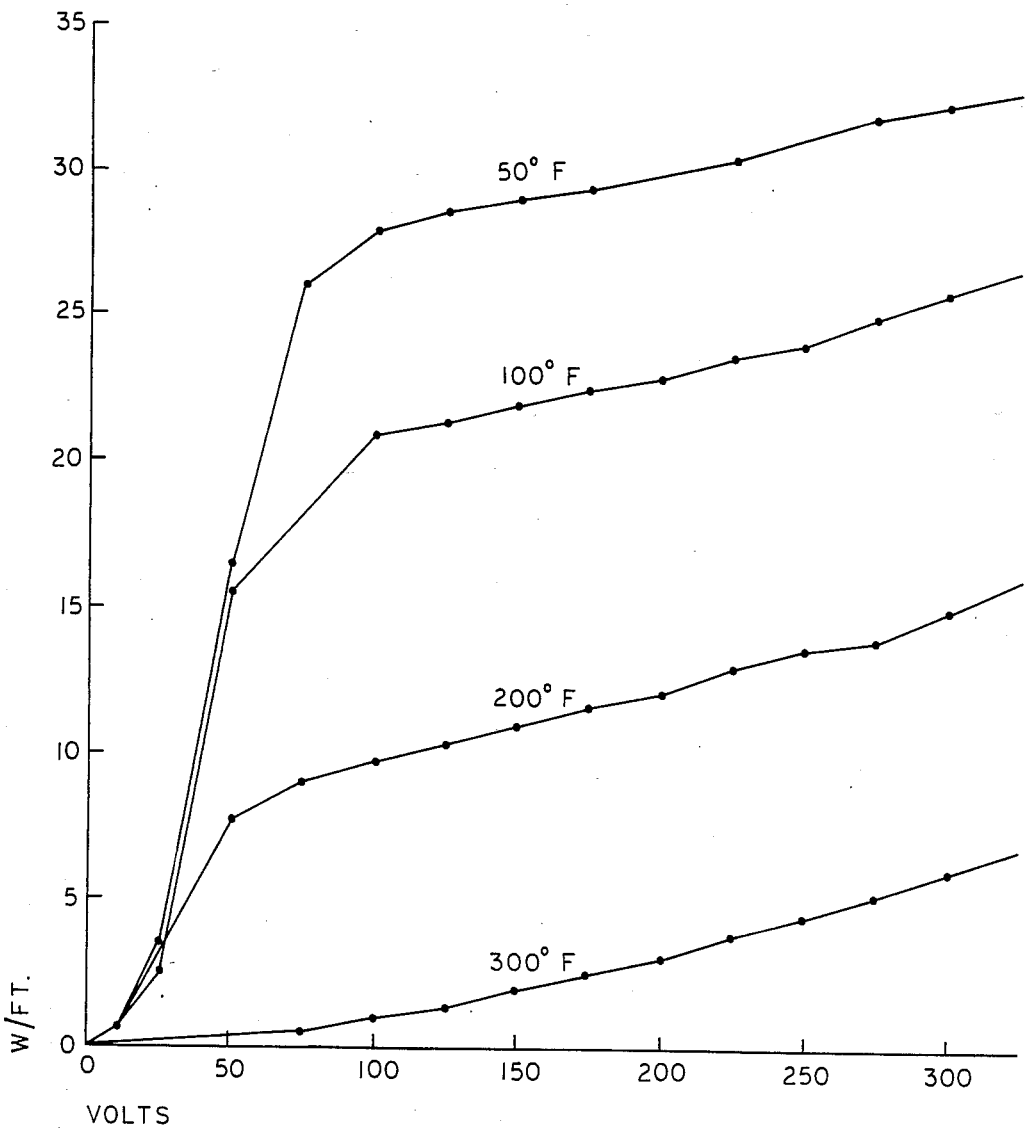
FIG. 8 is a graph representing the unit power produced at given temperatures and given voltages for a heating cable according to FIG. 2.

As can be seen from a comparison of FIGS. 7 and 8, the cable C1, designed according to the present invention, produced a significantly greater amount of power at a given voltage and temperature. For example, at 120 volts and 50° F., the prior art cable C0 produced 18.75 watts per foot while the cable constructed according to the present invention C1 surprisingly produced 28.5 watts per foot.

A one foot length of the heating cable C1 was placed in an environmental chamber set at 110° F. and powered at several different voltage levels until the power output closely approximated the power output of the previous example. The cable C1 as constructed in this example was energized at 50 volts and had a current reading of 0.284 amp to produce 14.2 watts of power. Thermocouple readings were also taken of the cable C1, with the thermocouple readings again taken adjacent the thermistor 16 and at a location midway between adjacent thermistors 16. The temperature determined at the thermistor location was 185° F. and the temperature at the midpoint location was 157° F., for a temperature difference of 28° F. As can be seen, the temperature difference between the thermistor location and the midpoint location was significantly reduced, thereby reducing the thermally induced stresses existing in the cable C1 because of differential temperature and the expansion that results therefrom and improving the uniformity of the heat levels supplied to the pipe or tank which the cable is attached.

Therefore, the present invention significantly improves the thermal conductivity of the cable so that the thermistor can produce greater power before going into a temperature self regulation mode. Additionally, because of the improved temperature distribution of the cable, thereby the thermal and mechanical stresses that develop therefrom are reduced.

It will be understood that because the heat is generated initially at the thermistors, the cable may be selectively formed or cut into any desired length while still retaining the same watts per foot capability for the selected length.

The foregoing disclosure and description of the invention are illustrative and explanatory thereof, and various changes in the size, shape and materials as well as in the details of the illustrated construction may be made without departing from the spirit of the invention, and all such changes being contemplated to fall within the scope of the appended claims.

We claim:

1. An electrical heating cable to provide heat to pipes, tanks and the like, comprising first and second conductor means extending parallel and spaced from each other along the length of the cable for conveying electrical current and for conducting heat;

heating means comprising a plurality of chips of variable resistance heating material electrically connected between said first and second conductor means at longitudinally spaced locations for producing heat when current flows therethrough, said variable resistance chips substantially increasing in resistance when a temperature limit is reached to reduce the current flowing through said heating means and control the heat output of the cable;

means for preventing contact between said first and second conductor means along the length of the cable; and wherein each of said conductor means comprises a substantially flat, elongated, multi-stranded electrical conductor having a thermal conductivity so as to conduct substantial amounts of heat relative to said means for preventing contact.

2. The heating cable of claim 1, including:

insulating material surrounding said conductor means to prevent possibility of short circuit or shock.

3. The heating cable of claim 1, wherein said last named means is an insulating material which has pockets at spaced intervals thereof in which said variable resistance chips are disposed.

4. The heating cable of claim 1, wherein each of said conductor means comprises braided copper wires.

5. The heating cable of claim 4, wherein said braided copper wire is plated.

6. The heating cable of claim 5, wherein the plating material is one of tin, silver, aluminum or nickel.

7. The heating cable of claim 1, wherein each of said conductor means comprises a plurality of electrically conductive fibers woven into substantially flat strips.

8. The heating cable of claim 1, wherein said last named means is an insulating material which separately encloses each conductor means, with portions thereof removed to allow connection between said variable resistance chips and said conductor means.

9. The heating cable of claim 1, wherein said last named means is an insulating material disposed between said conductor means for substantially the full length thereof except at said chips.

10. The heating cable of claim 1, wherein each of said conductor means comprises a plurality of parallel, adjacent, stranded wires.

11. A method of assembling an electrical heating cable, comprising:

preparing a first insulating means by removing portions of a substantially flat insulating material at spaced intervals thereof to form pockets;

inserting a plurality of variable resistance heating material chips for producing heat when a current flows therethrough into said pockets;

placing a first substantially flat, elongated conductor means for conveying electrical current and for conducting substantial amounts of heat relative to said first insualting means parallel to said first insulating means, along said first insulating means top surface, and in contact with said variable resistance chips;

placing a second substantially flat elongated conductor means for conveying electrical current and for conducting substantial amounts of heat relative to said first insulating means parallel to said first insulating means, along said first insulating means bottom surface, and in contact with said variable resistance chips;

electrically and mechanically connecting said variable resistance chips to said first and second conductor means; and forming a second insulating means by enclosing the structure formed by the previous steps with insulating materials for insulating the heating cable from the evironment.

12. A method for assembling an electrical heating cable, comprising:

preparing a first substantially flat, elongated conductor means for conveying electrical current and conducting substantial amounts of heat relative to an insulating material;

placing a plurality of variable resistance heating materials chips for producing heat when a current flows therethrough into contact with said first conductor means;

placing a second substantially flat, elongated conductor means for conveying electrical current and conducting substantial amounts of heat relative to an insulating material into contact with said variable resistance chips;

electrically and meachnically connecting said variable resistance chips to said first and second conductor means; and enclosing the struture formed by the previous steps with insulating materials for insulating each of said conductor means from each other and for insulating the cable from the environment.

13. An electrical heating cable to provide heat to pipes, tanks and the like, comprising;

first and second conductor means extending parallel and spaced from each other along the length of the cable for conveying electrical current and for conducting heat;

heating means comprising variable resistance heating material electrically connected between said first and second conductor means for producing heat when current flows therethrough, said variable resistance heating material substantially increasing in resistance when a temperature limit is reached to reduce the current flowing through said heating means and control the heat output of the cable;

means for preventing contact between said first and second cnnductor means along the length of the cable; and wherein each of said conductor means comprises a substantially flat, elongated, multi-stranded electrical conductor having a thermal conductivity so as to conduct substantial amounts of heat relative to said means for preventing contact.

* * * * *

UNITED STATES PATENT AND TRADEMARK OFFICE

CERTIFICATE OF CORRECTION

PATENT NO. : 4,794,229

DATED : December 27, 1988

INVENTOR(S) : David C. Goss and Chandrakant M. Yagnik

It is certified that error appears in the above-identified patent and that said Letters Patent is hereby corrected as shown below:

At column 3, line 48, delete "thetthermistors" and add -- the thermistors --.

At column 3, line 66 and 67, delete "226" and add -- 26 --.

At column 4, line 8, delete "eeating" and add -- heating --.

At column 4, line 23, delete "distribueed" and add -- distributed --.

At column 4, line 46, delete "faat" and add -- flat --.

At column 4, line 52, and 53, delete "conduciivity" and add --conductivity --.

At column 4, line 66, delete "cable C.." and add -- cable C1. --.

At column 6, line 18, delete "compleeed" and add -- completed --.

At column 7, line 11, delete "comprising" and add -- comprising: --.

Signed and Sealed this

Thirtieth Day of May, 1989

*Attest:*

*Attesting Officer*

DONALD J. QUIGG

*Commissioner of Patents and Trademarks*